United States Patent [19]

Appelmann

[11] Patent Number: 4,872,285

[45] **Date of Patent: * Oct. 10, 1989**

[54] QUARTER POINT RETURN MECHANISM FOR MANUALLY OPERATED REVOLVING DOORS

[75] Inventor: Horst Appelmann, Pickering, Canada

[73] Assignee: C. J. Rush Inc., Agincourt, Canada

[ * ] Notice: The portion of the term of this patent subsequent to Jan. 31, 2006 has been disclaimed.

[21] Appl. No.: 201,226

[22] Filed: Jun. 2, 1988

Related U.S. Application Data

[63] Continuation-in-part of Ser. No. 60,198, Jun. 10, 1987, Pat. No. 4,800,679.

[51] Int. Cl.[4] ..... E05D 15/02

[52] U.S. Cl. ..... 49/42

[58] Field of Search ..... 49/42, 43, 44, 45

[56] References Cited

U.S. PATENT DOCUMENTS

| | | | |
|---|---|---|---|
| 1,920,397 | 8/1933 | Johnson | 49/42 |
| 2,954,971 | 10/1960 | Simpson | 268/31 |
| 3,285,209 | 11/1966 | Pace | 109/8 |
| 3,349,876 | 10/1967 | Sheckells | 188/185 |
| 3,364,620 | 1/1968 | Hess | 49/43 |
| 3,497,997 | 3/1970 | Sheckells | 49/43 |
| 3,526,820 | 9/1970 | Sheckells | 318/467 |
| 3,678,623 | 7/1972 | Jenkins | 49/43 |
| 4,060,935 | 12/1977 | Miller | 49/25 |
| 4,255,900 | 3/1981 | Magnani | 49/141 |
| 4,295,297 | 10/1981 | Carroll | 49/42 |
| 4,530,183 | 7/1985 | Heise | 49/42 |

FOREIGN PATENT DOCUMENTS

WO82/02224 7/1982 World Int. Prop. O. .

*Primary Examiner*—Philip C. Kannan

*Attorney, Agent, or Firm*—Rogers, Bereskin & Parr

[57] ABSTRACT

This invention relates to a quarter point return mechanism for a manually driven revolving door. Revolving door leaves extending outwardly from a shaft are partially enclosed between opposed curved sidewalls. The return mechanism has a number of elements including an actuator, a rack arranged to be linearedly displaced by the actuator, and a pinion engaging the rack and being rotatable in opposite directions. The pinion is rotatably connected to the central shaft of the door. When the pinion is rotated in one direction, rotation is transmitted to the shaft. When the pinion is rotated in the opposite direction, the rotation is not transmitted to the shaft. Also included is a circumferential displacement sensor which operates the actuator when the outer ends of the door leaves are in a position circumferentially displaced from the sidewalls. The return mechanism returns the door leaves to a rest position in which the door leaves are in contact with the curved sidewalls. In an alternate embodiment the rack and pinion combination is replaced by a direct connection of the actuator to a one-way clutch. The clutch is then connected to the shaft.

9 Claims, 2 Drawing Sheets

QUARTER POINT RETURN MECHANISM FOR MANUALLY OPERATED REVOLVING DOORS

CROSS REFERENCE TO RELATED APPLICATIONS

This application is a continuation-in-part of Application Ser. No. 060,198, filed June 10, 1987 now U.S. pat. No. 4,800,679 dated Jan. 31, 1989.

FIELD OF INVENTION

This invention relates to revolving doors and in particular to a return mechanism for manually operated revolving doors. The return mechanism is to align the door leaves of the revolving door to the side walls in which the door rotates, to improve both the energy efficiency, and the presentation of the revolving door.

BACKGROUND OF THE INVENTION

Revolving doors are known and have been used extensively to provide a substantially weather resistant simultaneous ingress and egress facility in many modern buildings. Revolving doors are particularly well suited to prevent excessive energy losses that may arise from conventional doors, when it is either much hotter or much colder on one side of the door than on the other, because of the limited amount of air that may pass through the doorway of a revolving door.

Generally, the side walls of revolving doors are curved, and subtend an arc of slightly greater than 90°. The door leaves are usually supported from a central axle, at 90° to each other. The preferred alignment for the door, when not in use, is for two door leaves to be adjacent each side wall, which is commonly referred to as a quarter point alignment. With the quarter point alignment two weather seals are formed between the inside and outside of the building, and additionally, the doorway has a pleasing open look when approached by a person wanting to pass through the doorway.

There are essentially two types of revolving doors: those that have a power drive to assist in the rotation of the door, such as an electric motor, and those that are manually operated. In the manually operated revolving doors the rotating force for the door is provided by the person who seeks to pass through the doorway.

This invention relates to manually driven revolving doors, and in particular to a return mechanism for ensuring that when the door is not in use, the door leaves of the revolving door are aligned in the most efficient and aesthetic manner. Alignment mechanisms have been known and are used in association with power driven revolving doors, such as the devices shown in United States Patent No. 3,497,997, entitled QUARTERLINE STOP CONTROL SYSTEM FOR POWER DRIVEN REVOLVING DOORS.

Essentially the device of this prior patent, and other inventions of this type, operate in the following manner. Upon the revolving door being displaced from its resting position, for example by a person wishing to pass through the doorway, a switch is triggered activating an electric motor. The electric motor then rotates the door at a preselected speed. After a preselected amount of rotation, further switching occurs which can cause the door to slow down, and eventually stop with the door leaves at any desired location.

However, there are a number of undesirable limitations of the invention disclosed in this United States patent, and in these types of devices in general. Firstly, they require the use of a powerful electric motor able to accelerate the door to the preselected speed almost instantaneously. Also, because of the space constraints of the door frame it is often necessary to use a large number of heavy gauge interlocking gears to transmit the drive from the motor to the central axle of the door. Both of these requirements add considerably to the expense of the revolving door, and to the difficulty of manufacturing, installing and maintaining the door.

BRIEF SUMMARY OF THE INVENTION

A quarter point return mechanism for a manually driven revolving door having revolving door leaves extending outwardly from a central shaft and being partially enclosed between opposed curved side walls, said return mechanism comprising:

an actuator;

transmission means connecting said actuator to said central shaft, said transmission means transmitting rotation to said shaft when said actuator is actuated in a first direction and not transmitting rotation to said shaft when said actuator is actuated in a second direction; and sensing means for sensing circumferential displacement of outer-ends of said door leaves from said side walls, said actuator being actuated in said first direction when said sensing means senses said outer ends of said door leaves are in a position circumferentially displaced rom said side walls, said return mechanism returning said door leaves to a rest position in which said door leaves are in contact with said side walls.

BRIEF DESCRIPTION OF THE DRAWINGS

In the drawings, which illustrate embodiments of the invention.

DETAILED DESCRIPTION

Figure 1:
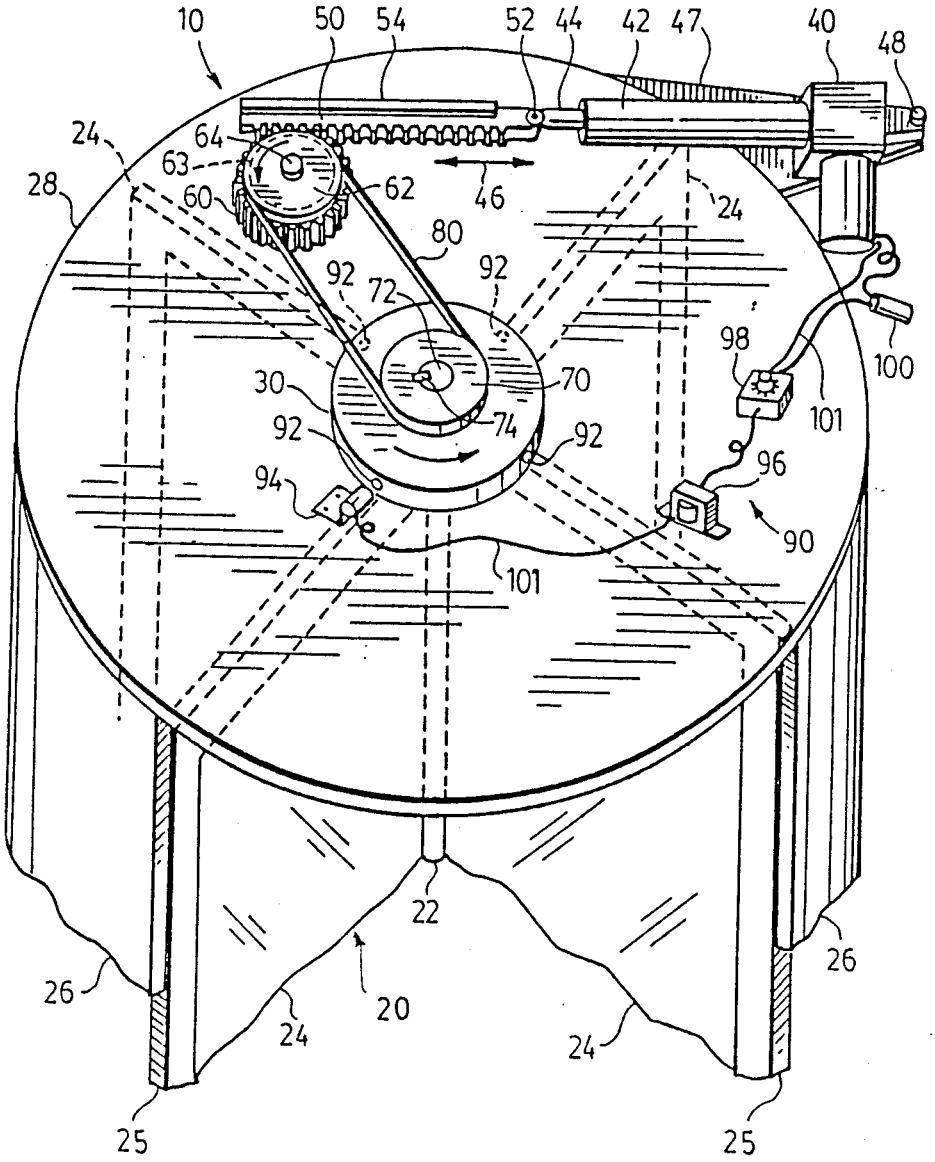
FIG. 1, is an isometric view from in front and above showing one embodiment of the invention.

In FIG. 1, a preferred embodiment of the return mechanism according to the present invention is shown and is indicated generally at 10. The return mechanism 10 is adapted to cooperate with a standard manually operated revolving door 20, in a manner as described herein.

Standard manually operated revolving door 20 has a number of elements, namely, a central shaft 22, four door leaves 24, side walls 26, overhead support 28 and overhead cam 30. As can be seen in FIG. 1, the door leaves 24 extend outwardly from the central shaft 22, and are preferrably at right angles to each other. Central shaft 22 is aligned on the axis of rotation of the door 20, and all door leaves 24 are of the same length. Central shaft 22 is free to rotate, by means of any standard bearing structure (not shown), and as the central shaft 22 rotates, so do the door leaves 24. As door leaves 24 are rotated the outer ends 25 of the door leaves 24 describe a cylinder of rotation.

Side walls 26 are spaced closely adjacent the outer ends 25 of door leaves 24 and are in the form of an arc when viewed from above. The angle subtended by the arc, and of side walls 26, corresponds to at least one quarter of the circle, or at least 90°, and preferrably is slightly more than 90°. The outer ends 25 of the door leaves 24 are usually equipped with flexible seals (not shown) which are in contact with the side walls 26 and which may slide relatively freely past the surface of sidewalls 26. Sidewalls 26 are normally free of any surface discontinuities which would impair the free sliding of such membranes over their surfaces.

An overhead support 28 is shown in the form of a circular plate, but can be of any shape. The overhead plate 28 serves to anchor the side walls 26 in place, and also provides support for centering the central shaft 22. The overhead support 28 is fixed and does not rotate when the door is in use.

An overhead cam mechanism 30 is affixed to the central shaft 22 by any conventional means such as a key and a keyway (not shown). The overhead cam can be of standard construction or may be a collapsing mechanism and is not described in any detail. The overhead cam 30 rotates as the door rotates and provides a bearing support surface between the overhead support 28 and the central shaft 22.

The return mechanism 10, as shown in FIG. 1, has a number of elements, namely, an actuator 40, a rack 50, a pinion 60 and first pulley 62, a second pulley 70, a belt 80, and a mechanism 90 for sensing the circumferential displacement of the outer ends 25 of the door leaves 24. The interrelationship of these elements will now be described.

The actuator 40 is a standard type, common in industry. In particular Electromechanical Actuator, made by, Duff-Norton, has been found to be satisfactory. The actuator 40 has an internal drive mechanism (not shown), and a driver housing 42, in which is located the drive 44. The driver 44 is in the form of an extendable arm. The driver 44, upon receipt by the actuator 40 of a trigger signal, described below, is driven outwardly by the internal drive mechanism of the actuator 40. Upon termination of the trigger signal, the drive mechanism reverses, causing the driver 44 to retreat to its initial position (as shown in FIG. 1). Double ended arrow 46 indicates generally the direction of movement of driver 44.

The actuator 40 may be attached by any conventional means in the dorway. However, it has been found satisfactory to add a bracket 47 which attaches to upper support 28, by any conventional means such as welding, upon which to fasten the actuator 40. A bolt 48 may be used to secure the actuator 40 to the bracket 47. The bracket 47 has the advantage of allowing the actuator 40 to be positioned so that driver 44 may be fully extended and retracted without interfering with the frame in which revolving door 20 is housed. In certain applications however, it may be more appropriate to position the elements of the return mechamism 10 so that the bracket 47 is not required, such as by attaching the actuator 40 directly to overhead support 28.

Attached to the outer end of the driver 44 is the rack 50. The rack 50 is attached to the driver 44 by means of a pin 52, and the rack 50 is guided by a guide 54 secured to support 28. The guide 54 is provided to ensure that the rack 50 fully engages with the pinion 60. As the driver 44 moves in and out, the rack 50 moves back and forth, engaging the pinion 60.

The pinion 60 and the first pulley 62 are mounted on the same central pin 64. A one way clutch 63 (shown as a dotted line) is provided between the pinion 60 and the first pulley 62. The one way clutch can be one of a number of standard types. Therefore, as the driver 44 is extended out from the actuator 40, both the pinion 60 and the first pulley 62 rotate. However, as the driver 44 is retracted, the pinion 60 rotates, and pulley 62 slips against the one way clutch without rotating.

The second pulley 70 is centered on central shaft 22, on the same axis as overhead cam 30. As shown in Figure 1 a keyway 72 has been cut into both the pulley 70 and the central shaft 22 into which a key 74 has been placed. In this manner, the second pulley 70 is non-rotatably fixed to the central shaft 22; as the central shaft 22 rotates, so also does the second pulley 70 rotate, and vice versa.

The belt 80 is looped over the first pulley 62 and the second pulley 70. The tension of belt 80 is preferrably adjusted so that the belt will slip, if someone uses the doorway while the return mechanism 10 is working to return the revolving door 20 to the quarter point alignment, but the belt will otherwise not slip while the driver 44 is extending outwardly from the actuator 40.

The mechanism 90 for sensing the circumferential displacement of the outer ends 25 of the door leaves 24 is composed of a number of elements, namely, four ferrous plugs 92, a proximity sensing switch 94, a transformer 96, a timer 98 and capacitor 100 are joined in an electrical circuit by wires 101 that includes actuator 40, as shown in FIG. 1.

The operation of the quarter point return mechanism 10 can now be described. In the rest position, the proximity switch 94 is adjacent one of the four ferrous plugs 92, and the door leaves 24 are aligned in the quarter point position as demonstrated by FIG. 1. However, as the door is rotated, for example by a person passing through the revolving door 20, the proximity switch 94 senses the non-ferrous material of overhead cam 30, and emits a trigger signal. The trigger signal is boosted by the transformer 96 and then delayed by the timer 98.

The timer 98 may be adjustable, to delay the transmission of the trigger signal onward through the electrical circuit by any desired time interval. For example, the timer can be set for a delay of three minutes. Also, the timer can be set to begin its countdown every time the trigger signal received from the switch 98 is interrupted. In this manner, a trigger signal sent by the switch 94 will not be communicated to the actuator 40 unless a ferrous plug 92 has not passed by the proximity switch (and therefore no fresh trigger signal has issued to the timer 98). Therefore, when the revolving door 20 is in use, the actuator 40 retains the driver 44 in the rest position.

However, if the rotating door 20 has come to rest with the proximity switch 94 aligned to the non-ferrous overhead cam 30, and has emitted an uninterrupted trigger signal for three minutes, then the timer will pass the signal on to the capacitor 100. Upon reaching capacitor 100, the trigger signal causes the capacitor 100 to release sufficient electrical energy to activate the actuator 40, which causes the driver 44 to extend outwardly from the actuator 40. In turn, the rack 50 acts on the pinion 60, rotating the pinion 60 and the first pulley 62 about the pin 64. The rotation of the first pulley 62 is transmitted to the second pulley 70 by the belt 80. As the second pulley 70 is rotated, so too is the central shaft 22, door leaves 24 and overhead cam 30.

As the overhead cam 30 is rotated, within one quarter revolution, one of the ferrous plugs 92 will become aligned with switch 94. When this occurs, the trigger signal from the switch ceases, breaking the electrical circuit to the actuator 40 and causing the driver 44 to stop its outward stroke. The actuator 40 can be equipped with an automatic return mechanism to cause the driver 44 to be withdrawn to its initial position. As previously described, as the driver 44 is returned, the rack 50 rotates pinion 60 in an opposite direction to the direction of the rotation during the outward stroke of driver 44, thereby allowing the first pulley 62 to slip against the one way clutch located between the pinion 60 and the first pulley 62. In this manner the orientation of the door leaves 24 is not altered during the return stroke of driver 44.

It will now be appreciated that the return mechanism 10 will operate to return the door leaves 24 to the quarter point position, when the door is not in use. Also, when the door leaves 24 have been returned to the quarter point position, the mechanism 10 automatically returns itself to the rest position, as shown in FIG. 1, primed to operate again.

Figure 2:
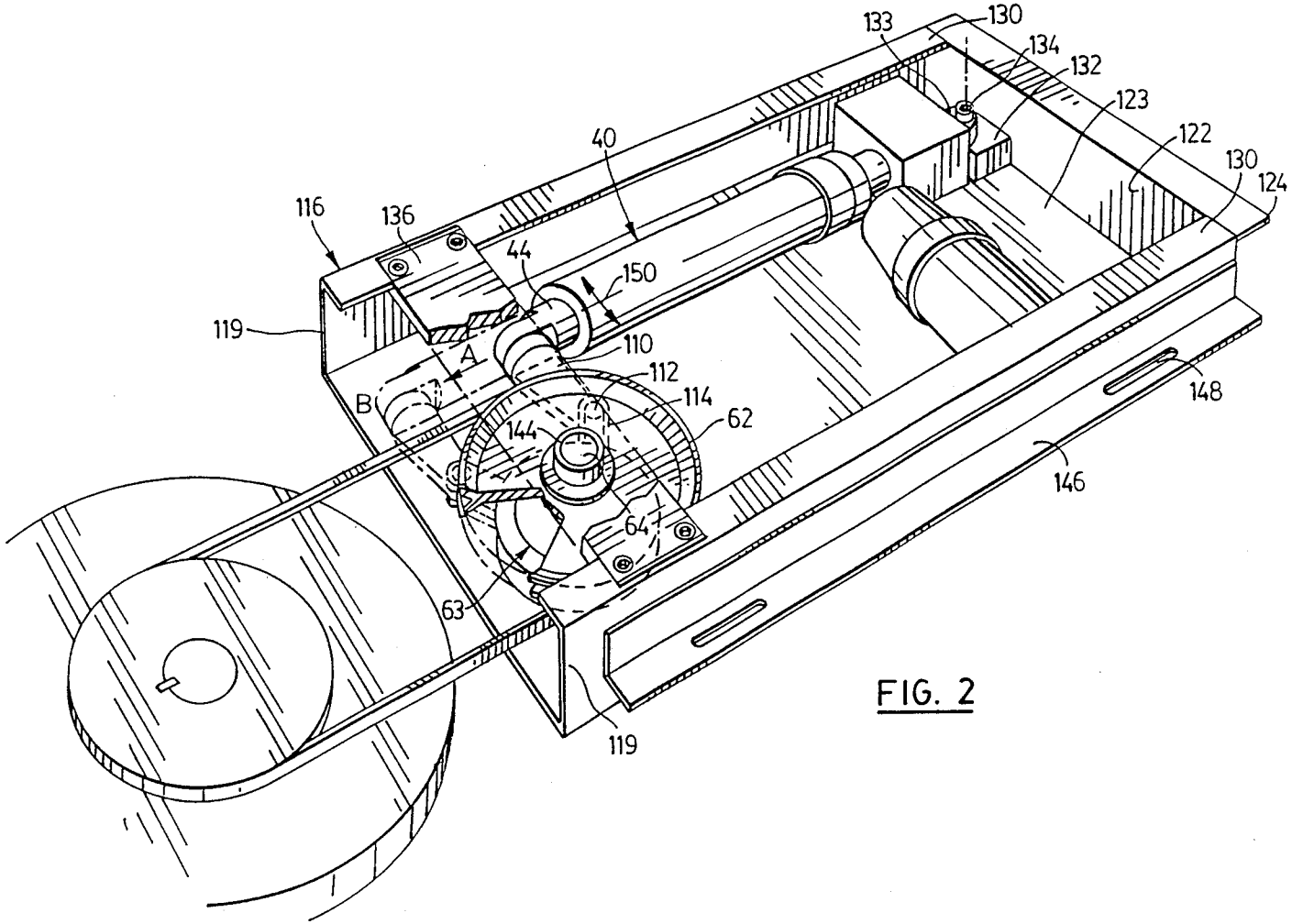
FIG. 2, is an isometric view from in front and above showing a second embodiment of the invention.

In an alternative embodiment the rack 54 and pinion 60 of FIG. 1 may be replaced by the configuration shown in FIG. 2. Like components in the two embodiments, those of FIGS. 1 and 2, will be given similar reference numerals and their description will not be repeated here.

The actuator 40 is secured to the one-way clutch 63 by way of an operating arm 110 bolted to the actuator driver 44, pivot pin 112 and a linkage arm 114 connectd to the one-way clutch 63. The operating arm 110, pivot pin 112, and linkage arm 114 are shown in dashed lines as they lie below the first pulley 62.

The one way clutch 63 and the first pulley 62 are mounted on the central pin 64 as in the embodiment of Figure 1.

The actuator 40 and the central pin 64 are mounted within a mounting cabinet 116. The mounting cabinet 116 has two sides 119, an end wall 122 with a lip 124 and a bottom 123. The sides 119 have inwardly extending tops 130. The sides 119 and end wall 122 are joined by welding or the like.

At one end of the cabinet 116 a block 132 is fixed, by being welded or the like between the bottom 123 and the wall 122. The block 132 has a bore, not shown, in which a pivot bolt 134 is inserted. The pivot bolt 134 also passes through a bore, not shown, in an end bracket 133 of the actuator 40. In this manner the actuator 40 is pivotally mounted to the cabinet 116.

An upper bearing plate 136 spans across the cabinet 116 from the tops 132 of each side 119 above the clutch 63 and first pulley 62. The bearing plate 136 has an opening, not shown, through which the central pin 64 fits. Below the clutch 63 is provided another opening, not shown, in the bottom 123 for the central pin 64. Thus the central pin 64 is rotatably housed in the two openings. A bushing 144 may be provided for the central pin 64 at the opening in the upper bearing plate 136. Another bushing, not shown, may be provided for the central pin 64 at the opening in the bottom 123.

The cabinet 116 has mounting brackets 146 along either side 119. Each mounting bracket 146 has a pair of socket slots 148. Only one such bracket 146 is evident in the perspective of FIG. 2. The brackets 146 and slots 148 provide a means for attaching the cabinet 116 to the overhead plate 28, by means of bolts or the like.

The alternative embodiment of FIG. 2 provides a more compact structure than that of FIG. 1, allowing for mounting of the cabinet 116 over the overhead plate 28. Also, the connection between the actuator 40 and the clutch 63 is provided in a simplified and more positive manner.

In operation the alternative embodiment acts in a similar manner to that of FIG. 1. The actuator 40, upon actuation moves the driver 44 from position A to position B (shown in ghost outline). Through the arms 110, 114 and the pivot pin 112 this causes the rotation of the one-way clutch 63. As the clutch 63 rotates the driver 44 is forced first toward the side 119 closest to the actuator 40 and then away from that side 119 because of the circular path described by the pin 112 at the end of the linkage arm 114. To provide for this displacement, actuator 40 pivots, as shown by the double-ended arrow 150, on the pivot bolt 134 following the motion of the driver 44.

The further operation of the alternative embodiment is substantially the same as that described for the embodiment of FIG. 1.

It will be appreciated by those skilled in the art that the preceding description relates to particular preferred embodiments of the invention and that many modifications are possible within the broad scope of the invention. Some of these modifications have been suggested above, and others will be apparent to those skilled in the art.

I claim:

1. A quarter point return mechanism for a manually driven revolving door having revolving door leaves extending outwardly from a central shaft and being partially enclosed between opposed curved side walls, said return mechanism comprising:

an actuator;

transmission means connecting said actuator to said central shaft, said transmission means transmitting rotation to said shaft when said actuator is actuated in a first direction and not transmitting rotation to said shaft when said actuator is actuated in a second direction; and sensing means for sensing circumferential displacement of outer-ends of said door leaves from said side walls, said actuator being actuated in said first direction when said sensing means senses said outer ends of said door leaves are in a position circumferentially displaced from said side walls, said return mechanism returning said door leaves to a rest position in which said door leaves are in contact with said side walls.

2. A mechanism as described in claim 1, wherein said transmission means includes a one-way clutch between the actuator and the central shaft.

3. A mechanism as described in claim 2, wherein, between the one-way clutch and the actuator, the transmission means further comprises;

a rack arranged to be linearly displaced by said actuator;

a pinion engaging said rack, said pinion being connected to the one-way clutch and being rotatable in opposite directions.

4. A mechanism as described in claim 1 or 3 further comprising, adjustable timing means located between said sensing means and said actuator, and arranged to permit said return mechanism to operate only after the revolving door leaves have remained stationary in other than said rest position for a timed interval.

5. A mechanism as described in claim 3, wherein, between the one-way clutch and the central shaft, the transmission means further comprises, a first pulley connected to the one way clutch, a second pulley centred on the central shaft and rotationally coupled to said first pulley, and a belt coupling said first pulley and said second pulley together.

6. A mechanism as described in claim 5, wherein said belt slidably engages said first and second pulleys permitting said door to be manually rotated while said return mechanism is in operation.

7. A mechanism as described in claim 1 or 3 wherein said sensing means includes a remote sensing switch and a plurality of trigger means, said trigger means tripping said switch upon rotation of said door.

8. A mechanism as described in claim 7, wherein said trigger means comprises four ferrous plugs and said sensing switch comprises an electromagnetic switch.

9. A quarter point return mechanism for use in a manually driven revolving door having four leaves equidistant about and extending outwardly from a central shaft, said revolving door being enclosed between two opposed curved sidewalls, each of said side walls having a length of at least one quarter of a circle of revolution defined by the outer ends of said door leaves, said return mechanism comprising an actuator, a rack arranged to be linearly displaced by said actuator, a pinion engaging said rack, a first pulley attached to said pinion, a one way clutch located between said first pulley and said pinion for transmitting drive to said pulley in response to turning of the pinion in a first direction, and a second pulley centered on and coupled to the central shaft, a belt slidably rotationally coupling said pulley and said second pulley together, means for sensing circumferential displacement of said outer end of said door leaves from said side walls, and operating said actuator when said outer ends of said door leaves are in a position circumferentially displaced from said side walls, said return mechanism returning said door leaves to a rest position in which each of said side walls is in contact with two of said outer ends of said door leaves.

* * * * *